US005253814A

United States Patent [19]

Pujol

[11] Patent Number: 5,253,814

[45] Date of Patent: Oct. 19, 1993

[54] MILLING BODIES SEPARATOR, IN THE COMMINUTING, CRUSHING AND DEAGGLOMERATING MILLS FOR SOLIDS DISPERSED IN LIQUIDS

[75] Inventor: Carlos O. Pujol, Badalona, Spain

[73] Assignee: Oliver Y. Batlle, S.A., Badalona, Spain

[21] Appl. No.: 891,639

[22] Filed: May 29, 1992

[30] Foreign Application Priority Data

Jun. 27, 1991 [ES] Spain ..... 9101516

[51] Int. Cl.[5] ..... B02C 17/16

[52] U.S. Cl. ..... 241/171; 241/174

[58] Field of Search ..... 241/171, 69, 46.17, 241/173, 172, 174

[56] References Cited

U.S. PATENT DOCUMENTS 4,651,935 3/1987 Samosky et al. ..... 241/65
4,887,773 12/1989 Mehltretter ..... 241/171
4,976,472 12/1990 Kozlov et al. ..... 241/172
5,114,080 5/1992 Pujol ..... 241/69

*Primary Examiner*—Timothy V. Eley
*Assistant Examiner*—John M. Husar
*Attorney, Agent, or Firm*—Lackenbach Siegel Marzullo Aronson and Greenspan

[57] ABSTRACT

Improvements in a mill for comminuting and crushing and disagglomerating solids, predispersed in liquids, that comprises: two interconnected bored parts forming the inlet pipe of the mill, having a seat and a buffer in its inner chamber, wherein a sphere and an opposing spring are disposed in said inlet pipe. One of the bored parts exhibits a projection with said buffer with passages for the product to be treated. A thin washer is detachably inserted and mounted in a groove, which surrounds the circular detent of the first sealing means, disposed within the shaft of the rotor and the stator of the mill. A propulsion drive means is disposed crosswise in the disk annexed to the free end of the shaft of the mill.

3 Claims, 5 Drawing Sheets

MILLING BODIES SEPARATOR, IN THE COMMINUTING, CRUSHING AND DEAGGLOMERATING MILLS FOR SOLIDS DISPERSED IN LIQUIDS

RELATED PATENT APPLICATION(S)

The petitioning entity of the present invention has developed some improvements to the object his U.S. patent application Ser. No. 718,338 now U.S. Pat. No. (corresponding to Spanish Patent No. 9002766), that has as an object a mill for comminuting and crushing and disagglomeration of solids, predispersed in liquids, which improvements have been obtained and are a product of experience in this industrial field and, in particular, of the corresponding tests and analysis resulting from putting into practice and execution the mill which is the object of the Spanish Patent No. 900276.

BACKGROUND OF THE INVENTION

The referenced U.S. main patent describes mills that are already known and indicates that its construction is relatively costly because its structure also relatively complex, there could be produced obstructions, especially of the grinding bodies or balls, particularly in the mills in which its rotor and, the stator exhibit sharp points protruding in the grinding chamber or chambers. Furthermore difficulties could arise during the starter of the mill, especially in the mills with rotors and stator having double annular cones. This will result in damage during production and lead to a corresponding down time needed for the removal of the obstruction, and to prepare the mill for a normal starting and a proper functioning.

The mill for comminuting and crushing and disagglomerating of solids, predispersed in liquids, includes a frame wherein a fixed body or stator is disposed, with a jacket for cooling and respectively, for the heating of the product being treated, in which interior is disposed a revolving body or a rotor fixed to a shaft, disposed along to the longitudinal axis of the mill and mounted in projection in corresponding support and bearing means, connected to the mill frame. The rotor shaft exhibits internal conduits for cooling means and respectively, case and moment, for heating of the rotor and is caused to rotate by actuating means through corresponding transmission and speed variation means connected to the frame. The grinding chamber delimited between said stator and rotor, in which are enclosed grinding bodies that are initially introduced into said chamber through a sealable inlet of the stator, in which lower part is disposed an exit also sealable for its evacuation, where the grinding chamber is traversed by the product being treated—while the rotor rotates—caused by impulsion means of the cited product, which are moved by actuating means and by transmission and speed change means. The stator includes an inlet for the product to be treated, which is connected to the outlet of the impulsion means and an outlet of the already ground product. Separator means are disposed in the outlet region and prevent the exit of the grinding bodies, however allowing the passage of the ground product. Sealing means for preventing the escape of the product that circulates continuously and forcefully through the grinding chamber are disposed between the stators and the shaft.

The mill is characterized in that the stators are composed by two half semibodies in form of hollow truncated cones, one in front and another in back, where their smaller closed bases are detachably connected to each other through their larger open bases. Said larger bases exhibit outer path flanges. Sealing means are disposed between said flanges and which semibodies are provided with outer covering involving paths, determined by respective cooling or respectively heating chambers. Each chamber includes an inlet and an outlet connection of the correspondent cooling or heating liquid. Since said front semibody exhibits the separator means of the grinding bodies centered in its smaller base and in its inner part, the outlet connection of the ground product by its outer part which serves at the same time, as a cooling and/or heating chamber, communicated with the corresponding chamber of the front semibody and with a connection, preferably of inlet connection, of the correspondent cooling or heating liquid. The back semibody exhibits centered in its smaller base, a central bore that is traversed by the mill shaft and the inlet connection of the product to be ground. Since the rotor—connected to the free end of said shafts disposed in the interior of the stator—is composed of a body comprising two hollow truncated cone, one in the front and the other the in back, interconnected by their larger open base, presenting the truncated cone in front of its closed smaller base, and with a central inlet, preferably also in form of truncated cone but of inverted position and with its smaller base opposing the interior of the rotor and connected to the end of the mill shaft. Said inlet of the mill shaft is disposed correspondingly with the fore cited separator means and the rear truncated cone has its closed smaller base traversed by said mill shaft to which is connected. The rotor exhibits in its interior conduit means of the cooling or heating liquid, disposed around the shaft, connected to same and connected to the correspondent inner conduit of same, which discharge said liquid in proximity of the inner walls of the rotor. The rotor exhibits also a recollection means of the referred liquid, connected to the corresponding inner conduit of the mentioned shaft of the mill, for its return towards the outside of the mill.

Moreover, the cited mill is characterized in that the sealing means between the stator and the shaft, provide a first hermetic seal, disposed next to the grinding chamber. The sealing means comprises a ring lodged in a peripheral circular channel of the shaft, in cooperation with a circular detent disposed in a groove of the inner wall of the smaller base of the semibody in the back of the stator—in the interior inlet of its central bore traversed by the shaft, and is applied tightly around said ring. In addition to the first seal there is provided a second conventional hermetic seal, disposed adjoining to the outer part of said smaller base.

SUMMARY OF THE INVENTION

The mill for commuting and crushing and agglomerating solids, predispersed in liquids, eliminates said inconveniences present in the already known mills and provides, among others, the advantages of a simpler structure, lower construction costs, of an easy and simple access into the interior of the grinding chamber, of a simple maintenance, of an easy cleaning, and of a simple replacement or repair of its first hermetic seal.

The improvements which are the object of the present invention are characterized in that the inlet port for the product to be treated, is composed of two axially and longitudinal hollowed pieces threaded and twisted between themselves, and provided with sealing means.

A sphere and an elastic means are disposed between said pieces, which constitute a non-return valve for the product to be treated. The first piece—or more distant piece form the mill stator—is provided with a chamber for said sphere and an inner seat for the adjustment of the sphere against same based on the opposing action of the elastic means. Said means rest with its opposite end on an inner projection, provided by the second piece—or the piece closest to the stator mill—. Said second piece exhibits at the same time an extension that is partially introduced into the interior of said chamber to delimit the sphere travel and exhibits at least a cross passage for the pressure circulation of the product to be treated, and which second piece is twisted with the semibody in the back of the stator.

Furthermore, the mentioned advantages are characterized in that the circular detent of the first seal of the sealing means, disposed between the stators of the mill and the shaft of its rotor and situated next to the grinding chamber, is surrounded by a washer of relatively little thickness embedded in a corresponding groove, with interpositioning sealing means and to which it is fixed with detachable connection means.

And, finally, the cited advantages are characterized in that the disk or pan, connected to the free end of the shaft of the mill, and which fastens the two integral parts of its rotor, provides propulsion means, preferably formed by at least one blade disposed crosswise with respect to the axis of the shaft.

The improvements, which are the object of the present invention, eliminate the inconvenience and provide advantages with respect to the art specified in the U.S. main patent, and moreover, provide the following advantages, among others, both with respect to the mill which is the object of the U.S. main patent, as well as with respect to the mills already known in the art; facilitating of cleaning and repair of the non-return valve disposed in the inlet conduit of the product to be ground, avoiding the formation of possible undesired deposits of product in the periphery of the first hermetic seal, and improving the cleaning in this part of the mill, and avoiding an undesired accumulation of the grinding bodies in or close to the longitudinal axis of the mill, in particular in the central part of the separator means of the cited grinding bodies and next to the output of the already ground product.

The improvements and objects of the invention offer the advantages that have been described above, in addition to others that become readily apparent from the exemplified embodiment provided with such improvements, that are described in more detail in the following. In order to facilitate the understanding of the characteristics described above, a more detailed description is given at the same time with reference to the drawings, which are given as exemplified embodiments and which are no limited to the extent of the present invention, but which are given as a practical example of same.

BRIEF DESCRIPTION OF THE DRAWINGS

In the drawings, the

FIGS. 1A and 1B show a vertical longitudinal sectional view of the mill; the

DESCRIPTION OF THE PREFERRED EMBODIMENTS

Figure 1A:
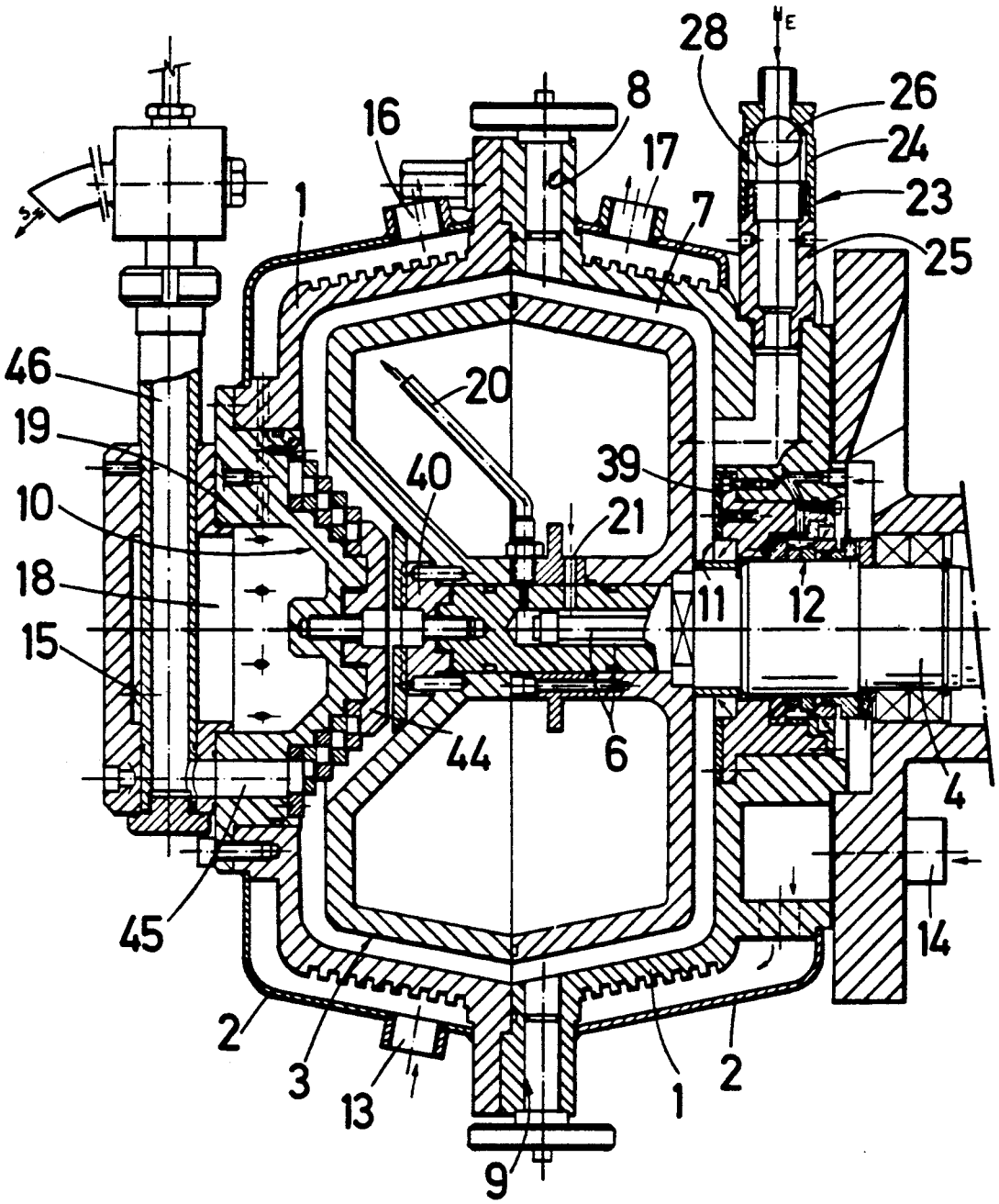
Figure 1B:
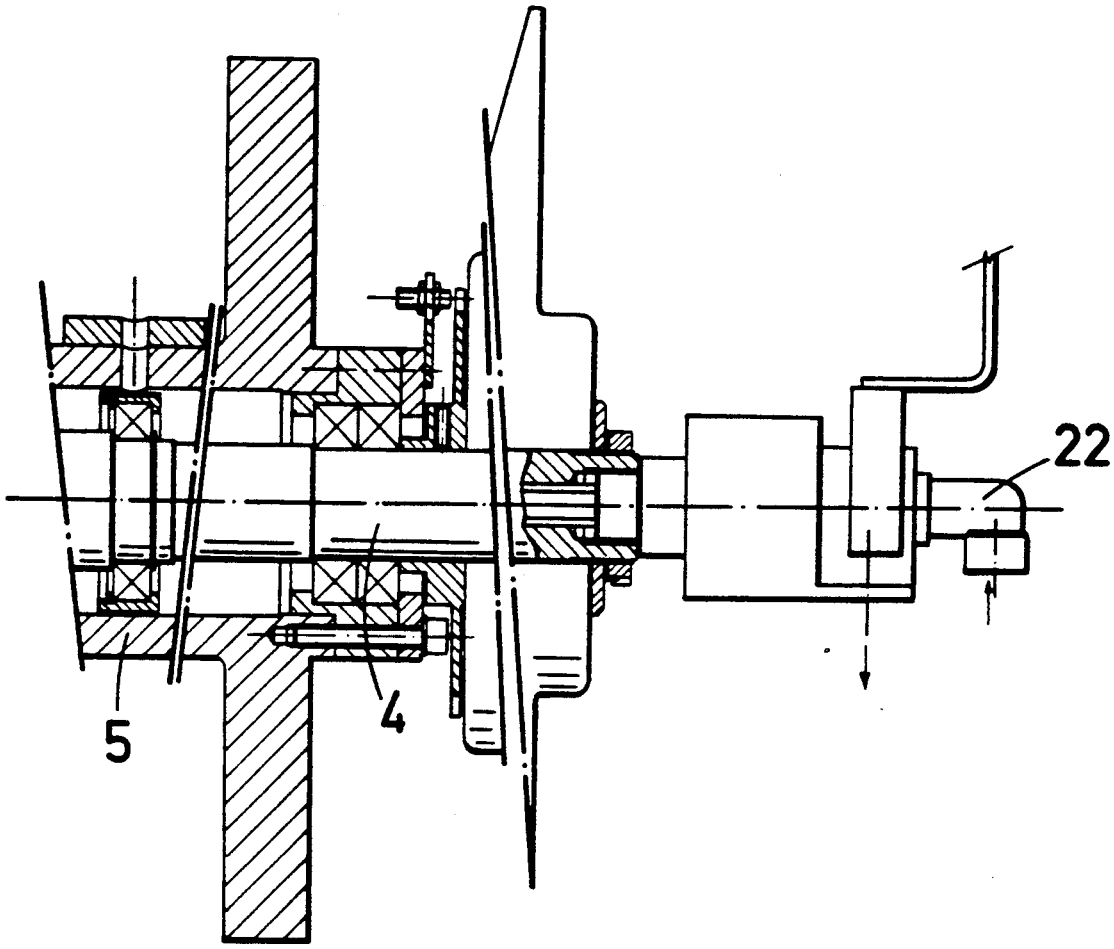

According to what is shown in the drawings, the mill for comminuting and crushing and disagglomera-sting solids, predispersed in liquids, comprises, in general, a divided stator (1) with a likewise divided jacket (2) for cooling or heating of the product being treated. A divided rotor (3) is disposed in the interior of the stator, fastened to a shaft (4) disposed along the longitudinal axle of the mill, which is mounted overhanging in corresponding rolling and support means (5). Said means are connected to the mill frame (not shown). Said shaft exhibits inner conduction pipes (6) for cooling and heating means of the rotor. The shaft (4) rotates based on actuation means and by means of corresponding conventional transmission and speed variation means (not shown), connected to the frame. The grinding chamber (7) is delimited between said stator and rotor. Grinding bodies are enclosed in the grinding chamber, which are initially introduced through the inlet (8) of the stator, said inlet can be closed and sealed. The lower part of the stator exhibits an outlet (9), which can also be closed and sealed to said grindable bodies.

The grinding chamber (7) is traversed by the product being treated—while the rotor rotates—by the action of conventional impulse drive means (not shown) of said product, which are moved by actuation means and through transmission means and speed variation means, also of conventional design (not shown). According to another embodiment, the product could come from an elevated storage, situated at an elevation higher than the mill, or from a feed network of the same.

The stator (1) has an inlet (E) for the product to be treated, connected with the outlet of the impulse drive means of the same; and an outlet (S) of the already ground product. A separator (10) is disposed in the outlet area and prevents the exiting of the grinding bodies, but allows the passage of the already ground product.

Sealing means such as the seals (11) and (12) are disposed between the stator (1) and the shaft (4), to prevent the escape of the product which circulates continuously and forcefully through the grinding chamber (7).

The jacket (2) exhibits inlet ports for the cooling or for the heating (13), (14) and (15), as well as with outlet ports (16) and (17). All of these ports are connected to the corresponding cooling or heating networks. The inlet port (15) leads into a chamber (18) which surrounds the outlet pipe of the already ground product and which, in this example, is connected through bores such as the bore (19), with the cooling or heating chamber or chambers, delimited between the jacket (2) and the body of the stator (1).

The rotor (3) is cooled or heated by pipes, such as the pipe (20), that shoot the cooling liquid and the heating liquid, respectively, into the rotor interior and which liquid returns through conduits such as conduit (21). Said pipes and conduits are connected to the inner conduction pipes (6) of the shaft (4), which lead and flow to the outside via the rotating interlocking device (22) of the shaft (4), which is connected to the corresponding cooling or heating network.

Figure 2:
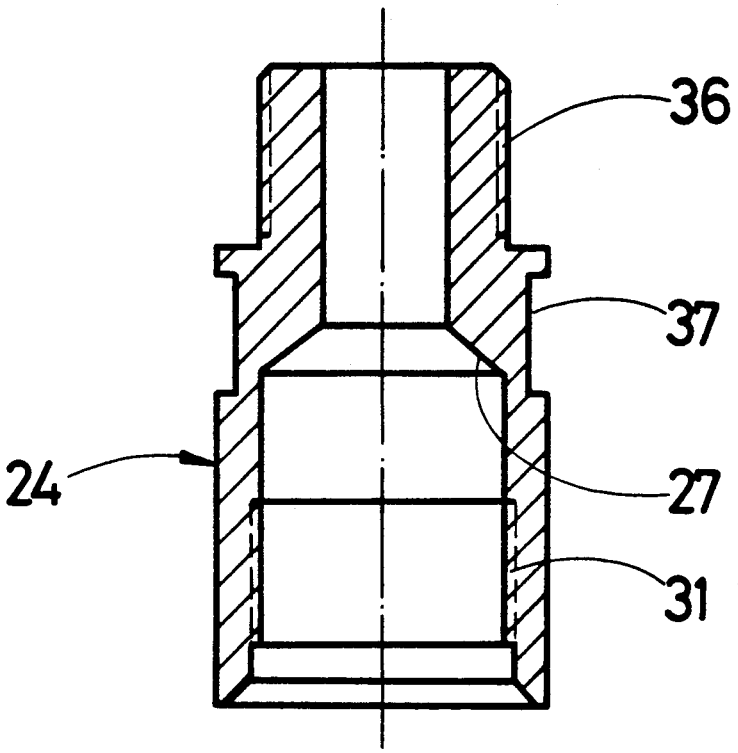
FIGS. 2 and 3 illustrate, in section, the two pieces which form the inlet of the product to be treated; and the FIGS. 4 and 5 correspond to a front view and to a plan view respectively of the propulsion means. The FIGS. 2 and 3 are at a different scale.
Figure 3:
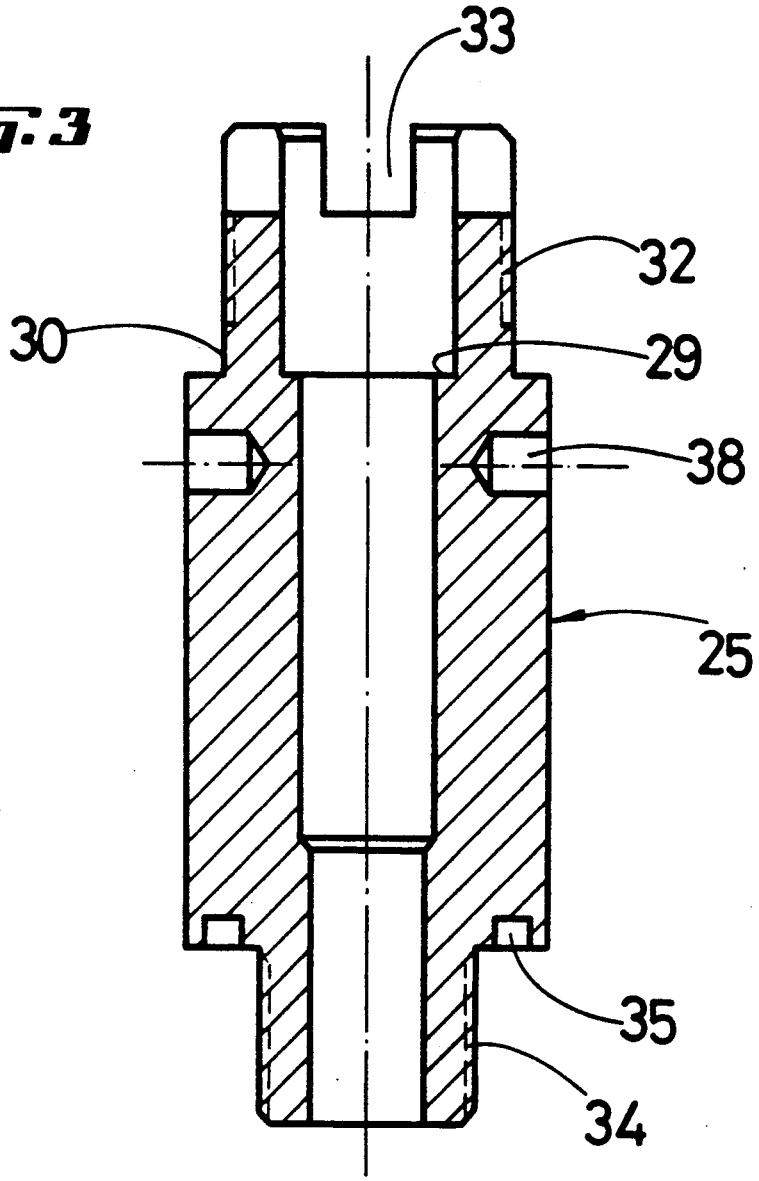

According to the aforesaid, the product to be treated is introduced to the mill through the inlet port (E) and through the inlet pipe (23), which is composed of the two pieces (24) and (25)—FIGS. 1A, 2 and 3—, the pieces (24) and (25) are axially and longitudinally hollowed and screwed into each other provided with sealing means in their joint. A sphere (26) is disposed between them, which sphere is fitted against the seat (27) (FIG. 2) of the piece (24) based on the action of an elastic means (28), such as a helicoidal spring. The elastic means rests with its opposed end on an inner projection (29) (FIG. 3) of the piece (25). The piece 25 has an extension (30) that is partially introduced into the interior of the chamber of the piece (24), wherein the sphere is disposed, screwing both pieces (24) and (25) together by their respective threaded areas (31) and (32). The extension (30) determines in its upper edge a stop that delimits the downward travel of the sphere (26)—when the fed-in product to be treated circulates in the mill—, providing the piece (25) with transversal steps such as the step (33), in order to allow the circulation under pressure of the product to be treated. The piece (25) in turn is screwed, and by means of the threaded area (34), onto the stator (1), in this example in its back part. Said piece 25 exhibits a circular channel (35) for receiving sealing means such as an elastic tonic ring, in its contact area facing the stator body.

The piece (24) exhibits an upper threaded area (36) for its connection by thread, and the corresponding sealing means, the conduit coming from the impulse drive pump of the product to be treated or from the storage of same or from its feeding network. Another conventional way for an adequate connection to the work pressure can be used instead of the thread (36). Said piece (24) exhibit means to facilitate its assembly and disassembly, such as for example an outer polygonal shape (37) on the basis of flat faces and disposed according to a hexagon or another suitable geometric figure, seen in a plan view. In the piece (25), such means consist in traversed blind bores such as the bore (30). Evidently, the cited means for facilitating the assembly and disassembly of the pieces (24) and (25), both between themselves and with respect to the stators body, could be any of the two cited means and any other conventional means for this purpose.

The pressure of the product to be treated entering by (E) surpasses the opposing action of the elastic means (28) pressing the sphere (26) against the upper port of the extension (30) of the piece (25). Accomplishing thereby the free circulation of the product to be treated through the non return valve, furnished basically by the sphere (26), the elastic means (28), and the chamber in that said sphere operates, as previously described, together with the seat (27) and the extension stop (30).

The sealing means (11), including in this example a gasket formed by a circular detent of the first seal according to the main patent, is disposed between the stator (1) of the mill and the shaft (4) of its rotor (3) and located adjacent to the grinding chamber (7). The sealing means is surrounded by a washer (39) of relatively small thickness and is fitted into a corresponding groove, by inserting sealing means and by fixing said washers in the interior of the groove with detachable joint means, such as screws or such. The cited washer has a much lesser thickness than the front part of the block in which the second hermetic seal or sealing mean (12) is mounted, thereby the volume of the possible deposits of product is limited and this damaging effect is diminished; (for example of such color that it "would stain" in the following operation of the mill with a product of another color or would modify this last one). Moreover, the assembly and disassembly of said front part of the block are eliminated with the second hermetic seal, which requires a defined precision, resulting in a time and specialized labor savings.

Figure 4:
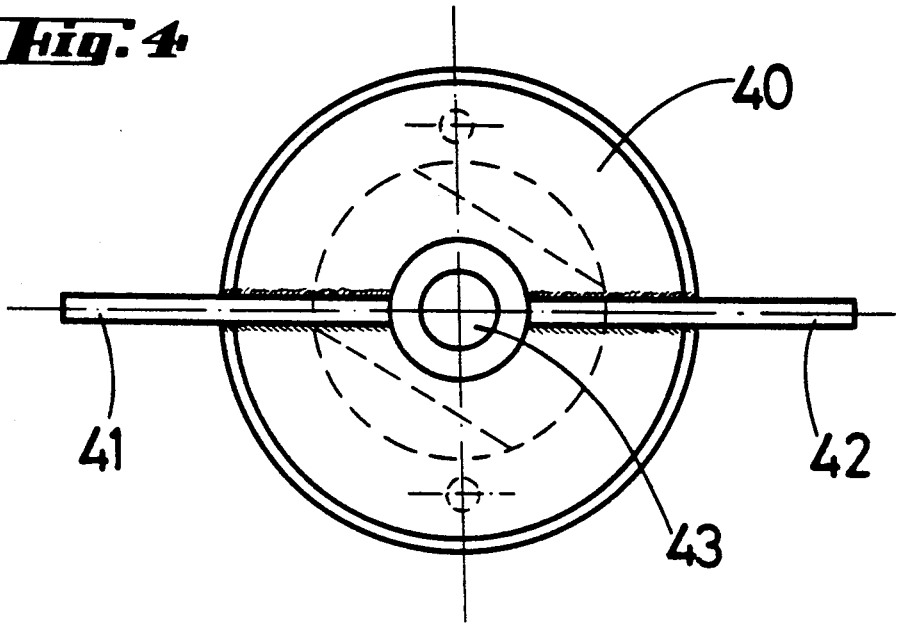
Figure 5:
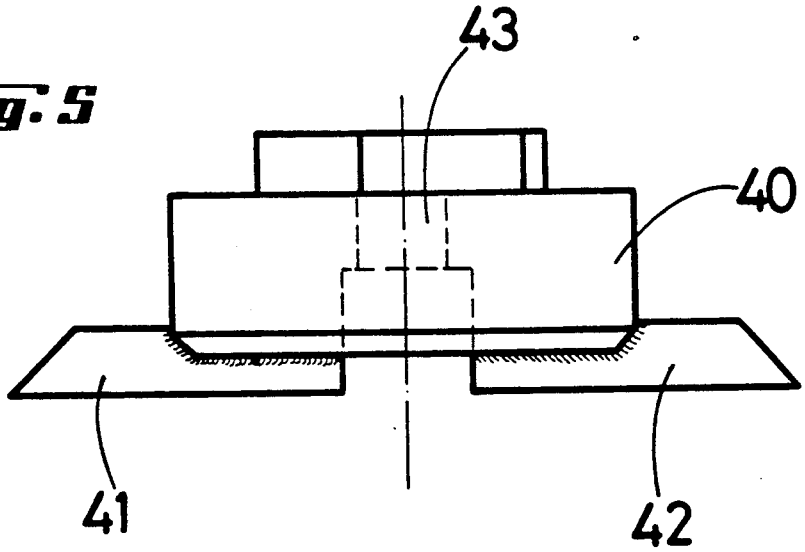

The disk or pan (40) (see FIGS. 1A, 4 and 5), is connected to the free end of the shaft (4) where the two integrant parts of its rotor (3) are fixed to the disk. The disk exhibits propulsion means that, in this example, are constituted by two blades (41) and (42), disposed cross-wise with respect to the shaft axis and in diametric position. The blades are welded to said disk (40), or can form a single body or be a one solid block with said disk (40). The cited disk (40) exhibits grooves in the opposite part, such as blind bores, to avoid a rotation of the disk with respect to the end of the shaft (4) in which said disk with its propulsion means is fixedly disposed. The disk (40) is also provided with a central bore (43) for passing through and retaining, in an intermediate step, a screw of the like for a firm joining to the shaft (4) FIG. 1A). Said blades are disposed next to the inner end (44) of the separator (10).

Finally, it is emphasized that the already ground product traverses (see FIG. 1A) the separator (10), and circulates through the longitudinal passage (45) and through the pipe (46)—surrounded by the chamber (18)—, and discharges from the mill by (S).

It should be made certain that in the realization of the improvements of the present invention various modifications and structural changes of constructive detail may be made without departing any way from the spirit of the present invention and in the following claims.

I claim:

1. In a mill having a grinding chamber, and a stater and rotor with shaft for comminuting and crushing and disagglomerating solids, predispersed in liquids, the improvement comprising an inlet port for product to be treated composed of two parts sealingly secured to each other, and having axially and longitudinally aligned hollowed openings, a sphere and resilient means, constituting a one-way inlet valve for product to be so treated, wherein the first part is provided with a chamber for said sphere and an inner seat for the adjustment for said sphere against said inner seat, based on the opposing action of said resilient means, and wherein said resilient means rest with an opposing end on an inner projection provided by said second part, and said second part having an extension extending into the interior of said chamber, and limiting the travel of said sphere; and said mill further having at least a cross wise passage for the pressure circulation of the product to be treated, and said second part being threadably secured to the body of said stater.

2. The improvement according to claim 1, further including a circular detent for sealing means disposed between said stator of the mill and the rotor shaft and located adjacent to said grinding chamber comprising a relatively thin washer fixed to said circular detent with removable fasteners.

3. The improvement according to claim 1, further including a disc connected to a free end of said shaft of said rotor with propulsion means in the form of a pair of blades disposed cross-wise with respect to the axis of said shaft and fixedly secured to said disc.

* * * * *

UNITED STATES PATENT AND TRADEMARK OFFICE

CERTIFICATE OF CORRECTION

PATENT NO. : 5,253,814

DATED : Oct. 19, 1993

INVENTOR(S) : Pujol

It is certified that error appears in the above—identified patent and that said Letters Patent is hereby corrected as shown below: On the title page: Item

[30] Foreign Application Priority Data to read as follows:

- - Jun.27, 1991 [ES] Spain.....9101517 --

Signed and Sealed this

Twenty-second Day of March, 1994

Bruce Lehman

BRUCE LEHMAN

*Commissioner of Patents and Trademarks*

*Attest:*

*Attesting Officer*